United States Patent [19]

Krug

[11] Patent Number: 4,574,044

[45] Date of Patent: Mar. 4, 1986

[54] METHOD FOR SPENT CATALYST TREATING FOR FLUIDIZED CATALYTIC CRACKING SYSTEMS

[75] Inventor: Russell R. Krug, Novato, Calif.

[73] Assignee: Chevron Research Company, San Francisco, Calif.

[21] Appl. No.: 608,229

[22] Filed: May 8, 1984

Related U.S. Application Data

[63] Continuation-in-part of Ser. No. 363,946, Mar. 31, 1982, abandoned.

[51] Int. Cl.[4] ..... C10G 11/05; C10G 11/18; B01J 29/38; B01J 38/06

[52] U.S. Cl. ..... 208/120; 208/113; 208/150; 208/151; 208/164; 422/144; 502/41; 502/55

[58] Field of Search ..... 208/150, 151, 113, 164, 208/120; 502/39, 41, 43, 51, 52, 55; 423/650–652

[56] References Cited

U.S. PATENT DOCUMENTS

| | | | |
|---|---|---|---|
| 2,391,336 | 12/1945 | Ogorzaly | 208/151 |
| 2,647,042 | 7/1953 | Mills | 208/150 |
| 3,412,013 | 11/1968 | Bowles | 208/120 |
| 4,149,963 | 4/1979 | Hann | 208/150 |
| 4,194,965 | 3/1980 | Billings | 208/113 |
| 4,274,942 | 6/1981 | Bartholic | 502/39 |
| 4,276,150 | 6/1981 | McHenry, Jr. | 502/39 |
| 4,388,218 | 6/1983 | Rowe | 502/43 |
| 4,464,250 | 8/1984 | Myers et al. | 502/43 |

*Primary Examiner*—P. E. Konopka

*Attorney, Agent, or Firm*—Burns, Doane, Swecker & Mathis

[57] ABSTRACT

A method for increasing the overall efficiency of fluidized catalytic cracking (FCC) with crystalline zeolitic catalysts is disclosed. Separated or spend cracking catalyst after reaction with hydrocarbonaceous material is first stripped and then subjected to an additional period of time in the presence of steam in the dense phase before the catalyst is returned to a regenerator. In a preferred form the spent catalyst after normal steam stripping is subjected to an additional period from ½ to 30 minutes at elevated temperature. This time is from 6 to 900 times the reaction time of the catalyst and hydrocarbonaceous mixture in an FCC reactor riser pipe. Such additional steam exposure allows the stripped spent catalyst to react with the steam to produce one or more significant benefits in FCC operations.

10 Claims, 17 Drawing Figures

METHOD FOR SPENT CATALYST TREATING FOR FLUIDIZED CATALYTIC CRACKING SYSTEMS

CROSS REFERENCE TO RELATED APPLICATIONS

This is a continuation-in-part application of application Ser. No. 363,946, filed Mar. 31, 1982 and now abandoned.

FIELD OF THE INVENTION

This invention relates to a method of fluidized catalyst cracking with crystalline zeolitic catalysts. More particularly, it relates to an improved method for increasing the overall efficiency of a fluidized catalytic cracker by subjecting the separated or spent cracking catalyst, after reaction with hydrocarbons to stripping in a dense phase to remove volatile hydrocarbons followed by an additional period of time in the presence of steam at the same temperature to condition the catalyst so that coke yield is further reduced and so that upon oxidative regeneration and recycling to the reaction zone additional gaseous and liquid products are generated at the expense of heavier hydrocarbons.

DESCRIPTION OF THE PRIOR ART

Fluidized cracking of heavy petroleum fractions is one of the major refining methods to convert crude petroleum oil to useful products, such as fuels for internal combustion engines. In such fluidized catalytic cracking, (known popularly as "FCC") high molecular weight hydrocarbon liquids and vapors are contacted with hot, finely divided solid catalyst particles in an elongated riser or transfer line reactor. The transfer line is usually in the form of a riser tube and the contacting time is on the order of a few seconds, say from 1 to 10 seconds, and generally not over about 5 seconds. During this short period, catalysts at temperatures in the range of from about 1100° F. to 1400° F. are contacted with a hydrocarbon feedstock frequently in the form of vacuum gas oil, cycle oil or the like, heated to a temperature of from about 300° to 800° F. The reaction is one of essentially instantaneous generation of large volumes of gaseous hydrocarbons. The hydrocarbons and catalyst mixture flows out of the riser tube into a reactor chamber wherein the resultant gaseous hydrocarbons are taken off for distillation into various product fractions defined by boiling ranges. The spent catalyst is then separated in the reactor vessel and stripped of hydrocarbons by passing the catalyst through a stripper section which includes steam flowing up through the down flowing catalyst usually in a period of 1–3 minutes. Catalyst is then returned to a regenerator where residual hydrocarbons, called "coke", on the spent catalyst are burned off by passing a stream of an oxygen-containing gas, such as air, or oxygen enriched air, through them until substantially all the carbon is burned from the particles. The heat generated in this regeneration step is used as a heat source to heat the catalyst and thus provides elevated temperatures needed for reaction with the incoming hydrocarbon feed. Regenerated hot catalyst is then recycled to the reactor riser tube.

A particular problem for this type of catalytic cracking process is to effectively "strip" the catalyst of hydrocarbons before it is recirculated to the regenerator. Prior to the present invention it has been believed that excessive stripper residence time did not benefit the process. That is, after interstitial strippable hydrocarbons were removed, no additional benefit would be noticed. Even absorbed hydrocarbons cannot be removed, according to experts in the field, Venuto and Habib who have reviewed the literature ("Fluid Catalytic Cracking with Zeolite Catalysts" by Paul B. Venuto and E. Thomas Habib, Jr. published by Marcel Dekber, Inc., New York and Basel, copyright 1979, page 15). Reduced coke levels are important to avoid overheating the system by exothermic oxidative removal of this coke from the catalyst. Upon regeneration, it is particularly important to remove this coke to low levels to regain the activity and selectivity of zeolitic catalysts. Catalysts for modern fluid catalytic cracking units typically contain such zeolites. Generally, zeolite catalysts are composed of a silica and/or alumina base and may include other refractory metal oxides such as magnesia or zirconia. More particularly they may contain combinations of silica and alumina containing from near zero to 50 wt % alumina, and crystaline alumino-silicates. In these catalysts it is particularly important to reduce coke content of deposits on the catalyst down to a range of about 0.1 weight percent of carbon.

It has been proposed to avoid overcracking and excessive coke formation on such catalysts by rapid disengagement of the cracking catalyst from the mixture of hydrocarbonaceous material and catalyst flowing out of the riser pipe. Such action is particularly important as pointed out in copending U.S. patent applications Ser. No. 238,380, filed Feb. 26, 1981, U.S. Pat. Ser. No. 335,458, filed Dec. 29, 1981 (now U.S. Pat. No. 4,414,100 issued Nov. 8, 1983), and U.S. Pat. Ser. No. 503,781, filed June 14, 1983, assigned to the assignee of the present invention. In those applications it is taught that a cyclonic motion imparted to the mixture of catalyst and hydrocarbonaceous material leaving the riser reactor effectively removes catalyst more quickly from the reaction product and improves the overall efficiency of the fluid catalytic cracking process. In said applications, the disclosures of which are incorporated herein by reference, there is disclosed a novel method of separating the catalyst after reaction with the hydrocarbonaceous material and before the catalyst is stripped for return to a regenerator by using a baffle arrangement adjacent the outflow from the reactor pipe.

SUMMARY OF THE INVENTION

As particularly distinguished from teachings of the prior art, the present invention is concerned with crystalline zeolite catalysts which have substantially more active sites and different characteristics than the older non-zeolitic cracking catalysts and contemplates normal steam stripping in a dense phase to remove volatile hydrocarbons followed by an additional short steam treatment or exposure before the catalyst is passed to the regenerator, the period for the additional treatment being sufficient to condition or modify the catalyst so that upon regeneration the catalyst is more selective and reactive. Contrary to the indications of the prior art, the additional period of steam treatment of the highly active zeolitic catalyst does not appear to cause deactivation but rather to condition the catalyst so that after oxidative regeneration, the catalyst is more selectively reactive in the reaction zone to convert more of the heavier hydrocarbons in the feed to desirable gases and liquids in the gasoline boiling range. Furthermore, the residence time of the catalyst-hydrocarbon fluidized reaction mixture in the dilute phase is not prolonged but can be decreased, thereby reducing undesirable overcracking. It is surprising that the short additional steam treatment of the spent catalyst before regeneration would so effectively increase the activity and selectivity of the zeolitic catalyst after oxidative regeneration, particularly for the short additional periods of ½ to 30 minutes, preferably ranging from 1 to 10 minutes.

Advantages of the present invention include the following: (1) heavier hydrocarbons, that is higher boiling range hydrocarbons may be used as the feedstock of the method without change in circulation rate or other flow modifications, (2) hydrocarbons of the same boiling range may be fed at a greater rate and/or with reduced recycling, (3) reduced quantities of additional fresh catalyst are required to maintain high catalyst activity after each regeneration step, (4) reduced quantities of steam are required in the catalyst stripper, (5) reduced amounts of oxygen are required for regeneration, (6) foul water production from the fractionator product is reduced, or (7) combinations of the foregoing improvements are obtained either singly or in multiple combinations with each other.

BACKGROUND OF THE INVENTION

U.S. Pat. No. 2,391,336 Ogorzaly proposes to increase yields and reduce wasteful coke by treating spent catalyst in a series of steps: first, the easily vaporized hydrocarbons in the interstices or on the surface of the catalyst are swept out of the catalyst in a fluidized dilute catalyst-hydrocarbon phase by a gas stream in a primary stripping zone (i.e., an increased dilute phase residence time); second, residual higher boiling materials adsorbed on the catalyst surface in a dense catalyst-hydrocarbon phase in an enlarged soaking or coking zone are decomposed to vaporized product and to coke on the catalyst; and third, the coked catalyst is cleaned up in a secondary stripper. The stripping is accomplished by inert gases such as nitrogen; Ogorzaly states that steam slowly deactivates the catalyst. This patent (issued in 1945) is about a process using amorphous silica-alumina catalysts then available and hence does not recognize the problems and techniques of using the more recently developed highly active zeolitic catalysts employed in the present invention. For example, zeolitic catalysts need a different type of reactor (a riser-type rather than a bed-type reactor) to take full advantage of their high cracking activity and yield selectivity. It is therefore not obvious that optimal stripping for amorphous catalysts would also be optimal for zeoltic catalysts. From the teaching of this patent it would be disadvantageous to use more steam because of the deactivating effect. Furthermore, the objective of the patent is, first, to strip hydrocarbons from an extended dilute phase of dispersed catalyst-hydrocarbon mixtures and then to decompose hydrocarbons adsorbed on the catalyst in a dense phase.

U.S. Pat. No. 3,412,013 Bowles proposes that in a fluid catalytic cracking process the spent catalyst is stripped of hydrocarbon by contact at elevated temperatures with hydrogen, thereby regenerating the catalyst for direct return to the reaction zone. Such hot hydrogen addition would be substantially higher in initial cost for equipment to perform such method as well as more costly to generate hydrogen and dangerous to handle.

In U.S. Pat. No. 4,295,961, Fahrig et al suggest that hydrocarbonaceous material be removed from the spent catalyst almost instaneously. They do not recognize that prolonged stripping at cracking temperature conditions in a gas, such as steam, would substantially improve the yield of hydrocarbonaceous products and beneficially condition the material remaining on the catalyst returning to the regenerator.

U.S. Pat. No. 3,767,566 Cartmell, issued Oct. 23, 1973 likewise discloses the undesirability of increasing coke level on the spent catalyst so that regeneration may occur at temperatures such that catalyst activity is not permanently impaired. In particular the patent teaches that secondary catalytic reactions and thermally induced conversions may lead to additional coke formation and to less valuable conversion products. The proposed solution is to closely control conversion reaction conditions and catalyst regeneration conditions. No mention is made of time for treating spent catalyst going to the regenerator.

Various patents such as U.S. Pat. No. 3,210,267 Plank et al and U.S. Pat. No. 3,536,605 Kittrell discuss the use of thermal treatment in the preparation of catalysts; Plank et al teach that catalytic selectivity of a composite catalyst increases with steam treatment at 800° to 1500° F. for at least two hours up to 100 hours; the examples given show steam treatment of freshly prepared catalyst for 20–30 hours at temperatures of about 1200° F. or higher. Although passing reference is made to steam exposure as may occur in use as well as prior to use, there is no recognition of any benefit from a steam treatment for a much shorter period of spent catalyst either before or after regeneration.

Further, Venuto and Habib, ibid, taught that the spent catalyst stripper does not remove absorbed hydrocarbons, but only displaces material present in the interstices between catalyst particles. It follows from such a teaching that additional stripper residence time beyond removal of such interstitial gases is wasted hardware.

As particularly disclosed in the present application, the spent catalyst stripping zone is desirably elongated so as to provide in addition to normal stripping a catalyst conditioning period after the conventional stripping to remove volatile hydrocarbons. While conventional steam stripping of spent catalyst is usually for a period of 1–3 minutes, the additional period for conditioning the catalyst in the presence of steam after the volatiles have been removed ranges generally from ½ to 30 minutes, more preferably in the range of 2 to 10 minutes. Most preferably the conditioning period is from about 1.2 to 5 times that of the normal stripping period. With respect to the reaction time between the hydrocarbons and the catalyst in the dispersed phase in the reactor, the additional period for conditioning the stripped spent catalyst ranges from 6 to 900 times longer than such reaction time. Accordingly, to accommodate such period for both conventional stripping and catalyst conditioning, the length of the zone for both functions must be substantially elongated from that which has heretofore been used in ordinary fluid catalytic cracking. Desirably such combined stripping and conditioning treatment may be carried out with less or no more than about the same amount of stripping steam presently used in conventional catalytic cracking operations. However, more steam may be used, dependent upon heat balance and circulation rates of the particular fluid cracking system. Generally however, less steam is required.

While applicant does not wish to be bound by any theory of operation, it is believed that in the present invention the highly active zeolitic catalysts promote the reaction of water with deposited hydrocarbons thereby removing hydrocarbon mass that would otherwise be coke and conditioning the remaining hydrocarbon mass and/or catalyst in ways not possible by an inert gas such as nitrogen, argon, etc. In the present invention there may also be some modification of the coke associated with the most active catalyst sites which would normally tend to produce light gases in the cracking reaction zone but these sites when so modified are more resistant to regeneration in the regenerator. The surprising result is that recycled regenerated catalyst treated in accordance with the present invention is more reactive for the desired reactions, i.e., is more selective for producing more gasoline boiling range product without additional very light gases such as methane, ethane and ethylene. The added treatment with steam apparently conditions the catalyst/coke so that upon regeneration the catalyst is more reactive and more selective, thereby producing less cycle oil and more gasoline.

It was also found in a test of the present process using deuterium oxide instead of water for the steam in the spent catalyst stripper/conditioner that the deuterium oxide reacted with the coke on the zeolite catalyst to the extent that all the hydrogen in the coke as detected by FTIR analysis was replaced by deuterium. This shows that in the relatively short additional steam treatment at temperatures of the order of 900° F. and usually below 1000° F. in accordance with this invention the steam reacts with the coke in the catalyst and modifies the spent catalyst before it enters the regenerator. Steam is essential for this reaction; inert gases such as nitrogen would not be effective.

Further, the additional treating time brings about a reduction in coke at the same catalyst circulating rates but more importantly brings about a conditioning of spent zeolitic catalyst so that after regeneration better yields of the desirable lighter products are obtained at the expense of the heavier products, e.g., cycle oils.

In a further embodiment of the present invention, the catalyst conditioning zone may be suitably extended so that the zone extends through a substantial portion of the regeneration zone, to further accelerate conditioning of the coke/catalyst prior to regeneration.

Other objects and advantages of the present invention become apparent from the following detailed description of the invention taken in conjuction with the accompanying drawings which form an integral part of the present application.

PREFERRED EMBODIMENTS OF THE INVENTION

Figure 1:
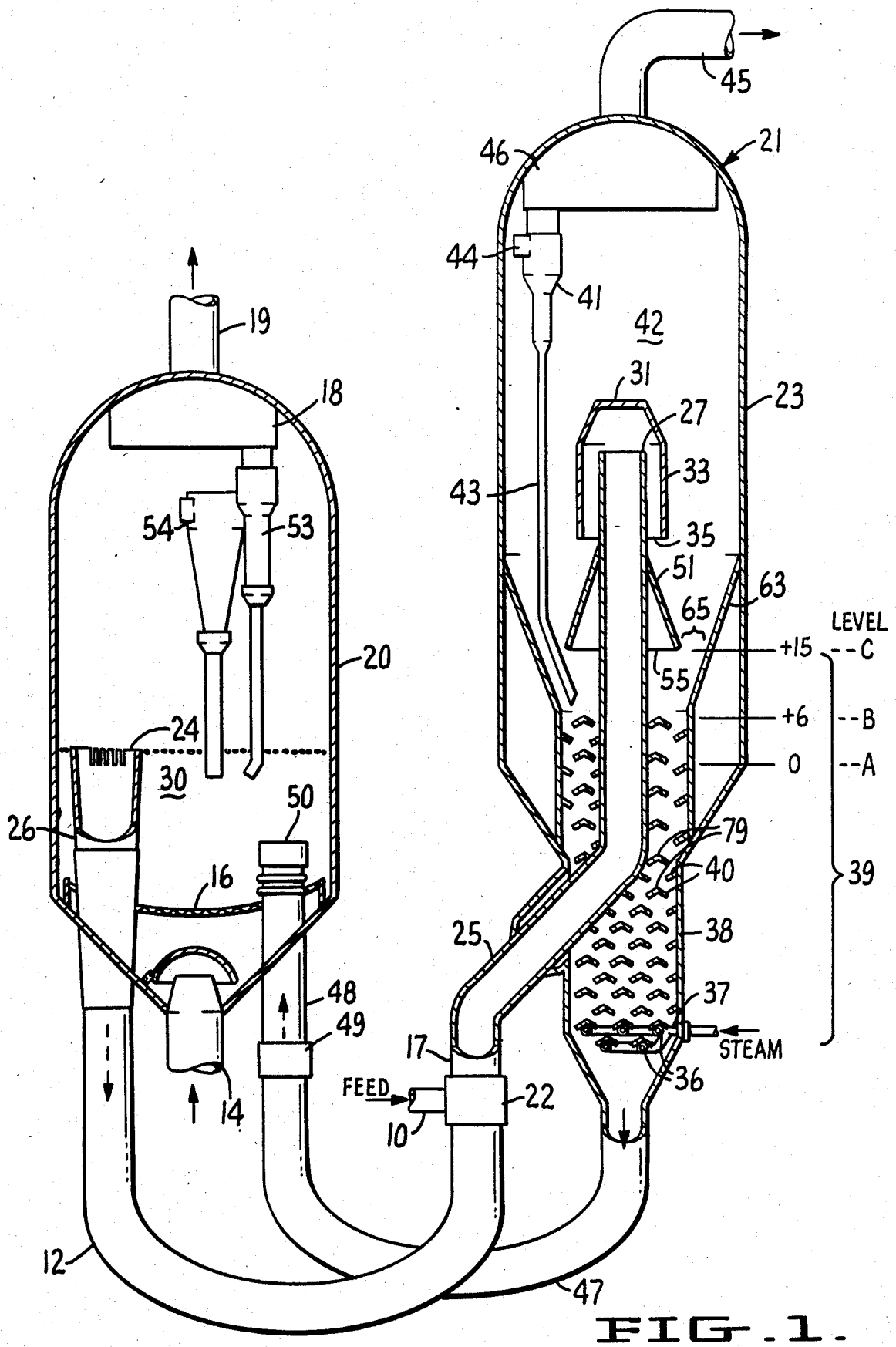
FIG. 1 is a schematic diagram of the fluid catalytic cracker in which the riser reactor enters the separator-stripper vessel from below and an elongated zone for stripping and catalyst conditioning is provided as described by the present invention.

The catalysts employed in this invention are modern highly-active crystalline zeolitic catalysts as distinguished from the less active amorphous silica-alumina catalysts that were in use from the 1940s to 1960s. Gates, Katzer and Schuit, "Chemistry Of Catalytic Processes" McGraw-Hill Book Co., 1979, pp 49–89, discuss the structures of crystalline zeolites and their greater activity and selectivity, stating, for example, that there is a greater concentration of active sites in the zeolite, often by a factor of 50. These authors state that zeolites X and Y, erionite and mordenite are of importance as catalysts in cracking and related reactions. Suitable crystalline zeolitic molecular sieve catalysts include those described in U.S. Pat Nos. 3,210,267, 3,140,251, 3,140,253, 3,536,605, 4,164,465 and 4,359,378 the disclosures of which are incorporated by reference. The crystalline zeolitic molecular sieve catalyst may be any type that is known in the art as a useful component of a cracking catalyst containing a crystalline zeolitic molecular sieve catalyst. A rare earth exchanged crystalline zeolitic catalyst is preferred.

Low alkali and low alkaline earth metal levels are most desirable for high cracking activity and hence such catalysts are preferred. For example, hydrogen-exchanged type Y zeolite is preferable to sodium Y. Hydrogen-form zeolites can be prepared by exchange with weak acid or by exchanging with $NH_4^+$ and decomposing the ammonium ion into $NH_3$ and $H^+$ which maintains the charge balance in the structure. This technique and the various techniques of the prepared various zeolites are well known.

Among the large-pore crystalline zeolites which have been found to be useful are zeolite X, zeolite Y and faujasite which have apparent pore sizes on the order of 7 to 9 Angstroms.

The chemical formula of zeolite Y expressed in terms of mole ratios of oxides may be written as: $(0.7–1.1)Na_2O:Al_2O_3:xSiO_2:yH_2O$, wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007.

The crystalline zeolitic cracking catalysts are prepared in various ways as are well known in the art. Usually the zeolitic material is dispersed as a powder in suitable binding matrixes such as amophous silica-alumina such as, for example, shown in U.S. Pat. No. 3,210,167 Plank et al. A typical commercial crystalline zeolitic cracking catalyst is an equilibrium catalyst marketed by Engelhardt and designated as HEZ-55 as a rare earth exchanged Y type faujasite having a lattice constant of 24.7, an X-ray diffraction relative to sodium Y faujasite of 19, total rare earth oxide content of 2.1%, surface are of 300 $m^2$/gm., pore volume of 0.4 $cm^2$/gm., and a silica-alumina binder.

Referring now to the drawings, it will be apparent that from the following description that the embodiments shown therein are largely schematic, indicating the relative relationship between the riser reactor, the reactor separator, the spent catalyst treating zone (i.e., the combination of a stripping portion followed in the flow path by a spent catalyst conditioning zone) of the present invention and the catalyst regenerator. And while only a few embodiments of such fluidized catalytic cracking units have been shown, it will be apparent that the advantages of the added catalyst conditioning zone in any such system results from holding reacted or "spent" zeolitic catalyst at an elevated reaction temperature in the presence of steam for an additional period of time after the catalyst has been stripped with steam but before return to the regenerator.

Referring now to the drawings, and in particular FIG. 1, there is shown an arrangement of a fluidized catalytic cracker and particularly a unit designed to maximize gasoline production from a heavy hydrocarbon feed with zeolytic catalyst. In this arrangement the maximum elevation of the spent catalyst treater bed was raised by 15 feet above the conventional stripper level to increase treater residence time. The same type of internals were used throughout the spent catalyst treating section to keep the same degree of mixing. Fresh feed of a higher boiling hydrocarbon feedstock is introduced as schematically indicated at 10 into reactor pipe 25. Preferably feed is introduced through multiple injection ports directed to assist the mixing of feed with catalyst flowing from regenerator 20 through line 12. The fluid mixture reacts to generate lighter hydrocarbons, primarily in gaseous form, in riser 25 and enters the reactor separator vessel 21. Hydrocarbon vapors are separated from the mixture through overhead cyclones 41 and cyclone inlet 44 and pass out of the top of reactor 21 by way of plenum 46 and line 45.

In the embodiment of FIG. 1 the catalyst-hydrocarbon mixture enters reactor vessel 21 on a downward path and encounters deflector baffle 51. Catalyst disengaging baffle 51 and side wall baffle 63 assist in rapid disengagement of catalyst from the hydrocarbonaceous vapors so that vapors rise upwardly in the reactor chamber 42 while catalyst is quickly directed as a dense phase into the spent catalyst treater section 39. Treater section 39, as shown includes a series of baffles 40 attached to the vessel wall 38, a part of vessel 21, so that spent catalyst passes downwardly through a tortuous path from the entry level at lower edge 55 of baffle 51 in reactor vessel 21.

In accordance with the present invention, and as particularly distinguished from the prior art, catalyst in treater 39 is arranged to be held for an extended period of time and at essentially the same temperature throughout substantially its full passage to line 47. Line 47 in the form of a large U-tube, returns catalyst to be regenerated (decoked) to regenerator 20 by the pressure differential between reactor vessel 21 and regenerator 20 and by the difference in hydrodynamic pressures generated in treater 39, spent catalyst riser 48 and regenerator bed 30 in regenerator vessel 20. It will be particularly observed in the embodiment of FIG. 1 that treater section 39 is extended substantially downwardly so that the desired elongated period for retention of catalyst therein, preferably for normal stripping followed by spent catalyst conditioning before it is returned to the regenerator 20 for "decoking". The temperature in the treater is held close to the reaction temperature due to good internal insulation of the vessel.

Air or other oxygen-containing gas is supplied (such as by blower 15 shown in FIGS. 10 and 1) by line 14 so that the carbon and hydrocarbons remaining on the returned catalyst in the regenerator are burned in an area directly above the grid 16. As the particles find their way through bed 30 they have their coke removed and eventually come to inlet 24 of overflow well 26. In this way regenerated catalyst overflows from the bed supported by grid 16 into overflow well 26 for mixing with hydrocarbon feed entering upflow leg 17 of riser 25 at feed nozzles 22. Waste gas from regenerator 20 is recovered in a plenum chamber 18 and exhausted through stack 19, which may include stack gas scrubbers and heat recovery means.

In greater particularity with reference to FIG. 1, reactor vessel 21 includes an outer generally cylindrical shell 23 for containing catalytic reaction mixture material and steam therein. Reactor riser conduit 25 is arranged generally within the vessel 21. As shown in the drawings, riser conduit 25 enters the vessel from the side thereof and extends upwardly from a lower end of the vessel to a conduit upper end 27 which is spaced from the top of the vessel 21. The riser conduit may also enter vertically from the lower end of the vessel 21.

Riser conduit 25 provides an upwardly extending passageway for the flow of a mixture of catalyst and reactant, such as hydrocarbons which enter riser conduit 25 through line 10. Steam may also be added to riser conduit 25 in a conventional manner as by injection with the feed.

Arranged above and surrounding the conduit upper end 27 is a hat-like shroud member 31 for deflecting the resulting hydrocarbon vapor/catalyst mixture downwardly into the vessel 21. The shroud member 31 may be secured above end 27 of riser conduit 25 by any suitable arrangement. For example, I-beams (not shown) across the vessel may be used to support the shroud member. A depending, generally cylindrical wall 33 of shroud member 31 surrounds riser conduit 25 and provides a downwardly directed annular outlet 35 for discharging the hydrocarbon vapor/catalyst mixture to the inside of the vessel 21 from the riser conduit 25.

The catalyst falls downwardly primarily by inertia and gravity from the outlet 35 of the shroud member 33 and flows into the treating zone 39 arranged at the lower, reduced diameter end of the vessel 21. The treating zone includes a plurality of rows of baffles 40 which promote good catalyst/steam contacting. Baffles 40 may be of any known type arranged within the treating zone 39. If the riser conduit 25 enters vessel 21 from the side, it may be desirable to provide perforations 79 in those baffles 40 which are in the area where the riser conduit 25 enters vessel 21 in order to compensate for the decreased flow area caused by the side entrance of the riser conduit 25.

Hydrocarbons associated with the catalyst particles are separated therefrom by a flow of stripping steam introduced into the lower portion of the vessel 21 through a suitable inlet manifold 37 feeding a plurality of injection nozzels 36 under the lowest row of baffles 40. The gaseous hydrocarbon conversion products stripped from the catalyst are convected to space 42 above riser conduit 25 and riser outlet 35. Catalyst particles entrained with the upward flow of steam and hydrocarbon products are separated in at least one cyclone separator means 41 arranged in an upper portion of reactor vessel 21. Particles of catalyst, including fines, are delivered to the lower end of reactor vessel 21 through outlet lines, or dip legs 43 from cyclone separators 41. The hydrocarbon products and unseparated catalyst particles are conveyed for any suitable further processing through an outlet line 45.

As disclosed in copending application, Ser. No. 238,380, a catalyst disengaging baffle 51 deflects the hydrocarbon vapor/catalyst mixture discharged from the annular outlet 35 toward the outer periphery or wall of the vessel 21. The top of the riser baffle 51 is spaced just below the outlet 35 to avoid a narrowing of the cross-sectional area of the outlet. This ensures that riser baffle 51 is effective to promote early disengagement of catalyst from the mixture discharged from the outlet 35.

Riser baffle 51 is arranged to deflect the catalyst particles such that the particles of the mixture are subjected to a partial cyclone separation to promote early disengagement of catalyst from the reaction mixture. Desirably spent catalyst is disengaged from the hydrocarbon vapors as soon as possible and flows as a dense phase into treater section 39 of vessel 21.

To operate in a preferred manner, the level of the fluidized dense portion of the catalyst in treater zone 39 within vessel 21 should be maintained at a level no higher than the lower end 55 of the riser baffle 51. This level is kept high enough to provide sufficient head to maintain adequate catalyst circulation rates and maximal catalyst "treating". If the catalyst bed rises above the riser baffle lower edge 55, the amount of entrained catalyst delivered to the cyclones 41 increases rapidly and yield selectivity degenerates producing too much gas and coke. A higher catalyst bed level would also interfere with the desired deflection, turning, and contacting with steam by the particles. Accordingly the catalyst bed is maintained at or below the lower end 55 of the riser baffle 51, but high enough to maintain adequate catalyst circulation rates. And in accordance with the present invention, this level is as high as possible to extend the residence time of catalyst flowing through treater zone 39.

Riser baffle 51 alone is effective to reduce the amount of catalyst delivered to the cyclones and to aid in separating hydrocarbon vapor products from the catalyst. Such action may be further enhanced by employing additional baffles above the treater zone 39. Specifically a catalyst disengaging wall baffle 63 deflects the catalyst mixture (now mostly catalyst), and promotes further cyclone separation of catalyst from the vapor or gases. Wall baffle 63 is arranged on the inside of the shell 23 such that the cross-sectional area 65 for catalyst flow between baffle 63 and the end 55 of catalyst disengaging baffle 51 is approximately the same as the cross-sectional area for flow of catalyst in lower treater section 39. Wall baffle 63 is angled inwardly from the location at which it is attached to the vessel wall 23. The lower end of the wall baffle 63 preferably connects with the cylindrical portion of the treater zone 39. This connection presents a smooth transition for particles flowing generally downwardly within vessel 21 toward treater zone 39.

Figure 7:
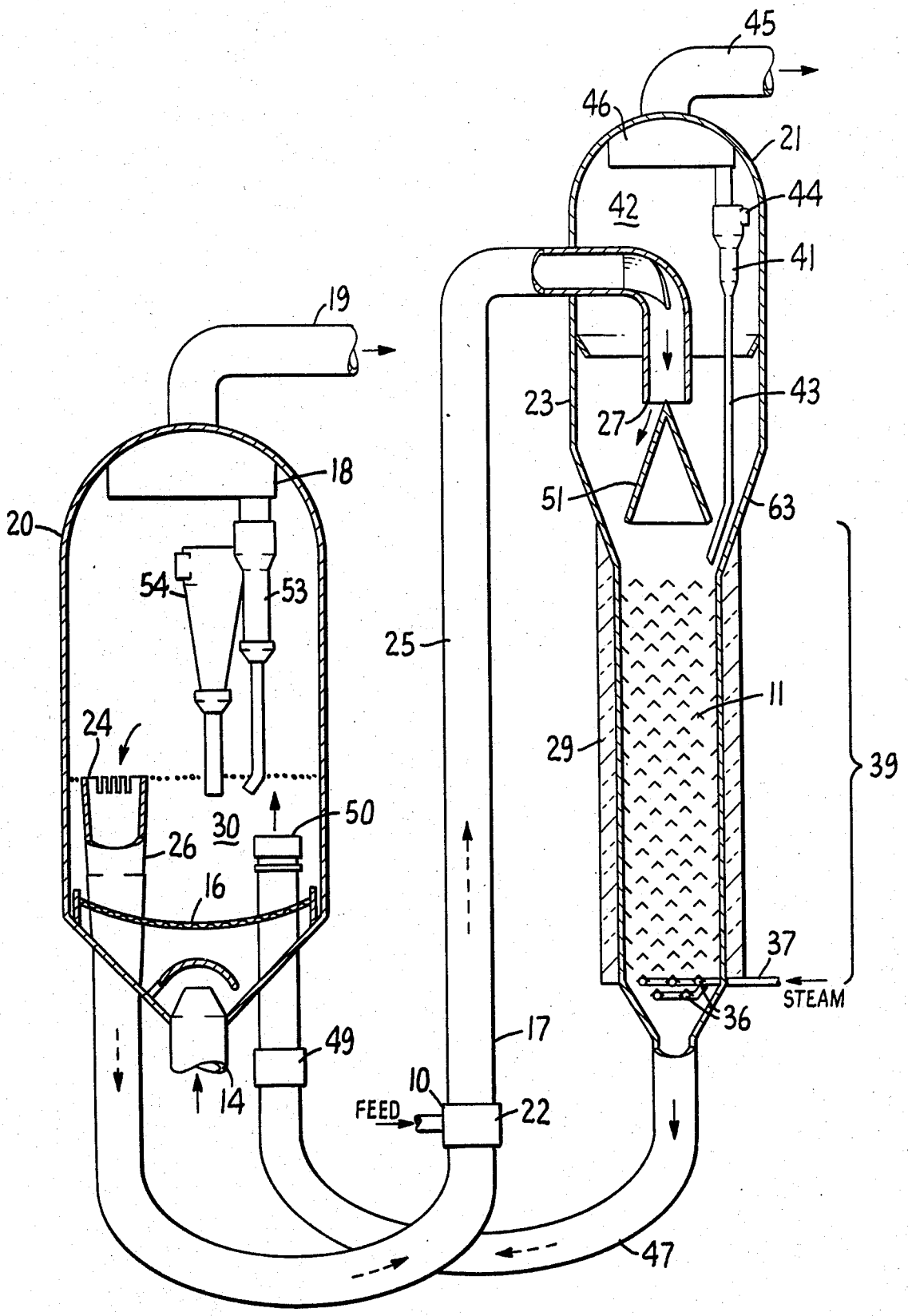
FIG. 7 is a schematic elevation view, partially in cross-section, similar to FIG. 1 of an alternate arrangement of a fluid catalytic cracker using an external riser pipe system and employing one of the preferred embodiments of a spent catalyst treater according to the present invention.

Wall baffle 63 may be arranged as a separate baffle member or may be formed as a portion of the vessel wall 23, as in the arrangement of FIG. 7.

In order to allow for downward flow of separated catalyst between the baffles, the cross-sectional area of the annular opening 65 formed between the lower end 55 of the riser baffle 51 and the wall baffle 63 is preferably approximately the same as the cross-sectional area (within±50%) of any lower portion of main spent catalyst stripping-conditioning zone 39. As the catalyst flows downwardly, the dense phase of catalyst should not build up above the lower end 55 of the riser baffle 51.

It is to be noted that riser baffle lower end 55 defines the separation between the hydrocarbonrich area above this level and the steam-rich area below the riser baffle 51. Most of the catalyst is separated from the hydrocarbon products within the partial cyclone zone created between baffles 51 and 63. The separated hydrocarbon vapors with a smaller quantity of steam are convected upwardly to the inlet ports 44 of cyclone separator 41 at the top of vessel 21. The area below the lower end 55 of the riser baffle 51 is rich in steam since the steam inlet manifold 37 is arranged near the lower end of the vessel and a lesser but significant quantity of hydrocarbon products remain on the catalyst after cyclone separation. Additional hydrocarbon products are removed as volatiles from the upper steam stripping portion of the treating zone 39 prior to discharge of catalyst through outlet line 47 for delivery to the regenerator 20 through control gate valve 49. Air can be introduced at 49 to help siphon catalyst from the vessel 21 to vessel 20.

Preferably the ends of outlet lines, or "dip legs", 43 (for returning catalyst from the cyclones 41 carried overhead with the vapors) terminate below the lower end of the catalyst disengaging baffle 55 and above the baffle internals within treating section 39. It is preferred to discharge catalyst from the cyclones into a catalyst downflow region to minimize reentrainment of the catalyst fines by the vertically rising vapors. Ample space is left in this region to prevent blockage of downward catalyst flow.

The cross-sectional area 65, between the predominantly steam phase and the predominantly hydrocarbon phase is as high as possible in vessel 21 provided that it is not so high as to interfere with the action of cyclones 41. Raising the elevation of area 65 has three desirable effects: first, treater residence time is increased; second, dilute phase residence time with the spent catalyst is decreased to minimize undesirable secondary cracking reactions in the dilute phase; and, third, maximum achievable hydrostatic head of catalyst dense phase is increased which increases the maximum achievable rate at which catalyst can be circulated through the entire fluidized catalytic cracker unit.

EXAMPLES

In a commercial fluidized catalytic cracker unit, built in general accordance with the FIG. 1 embodiment of the present invention, tests were made during a period of constant feed quality and constant catalyst composition. The following data, shown in FIGS. 2 to 6 were developed from one of these commercial units using a commercial zeolitic catalyst mixture described hereinabove.

Figure 2:
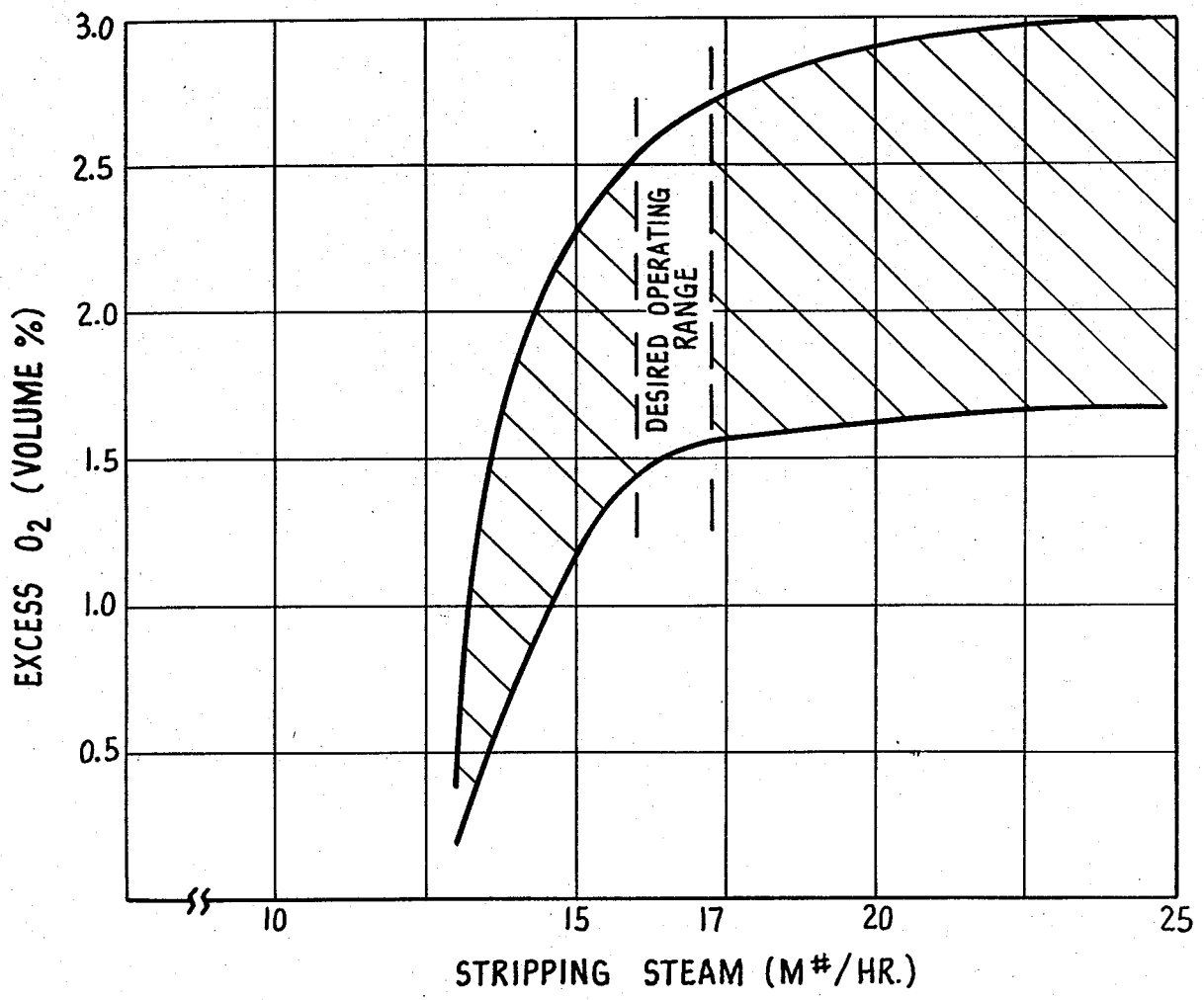
FIG. 2 is graph illustrating a spent catalyst stripping operation, as measured prior to adding the conditioning section, in which regenerator excess oxygen, in volume %, is plotted against the rate of steam supplied to the conventional stripping section. Operations of the unit over typical operation ranges are shown. Air is fed to the regenerator at a fixed rate and the excess oxygen is that oxygen in the regenerator flue gas. This excess oxygen varies with the amount of fuel (coke on catalyst or torch oil) fed to the regenerator.

A stripping steam survey in the unit before the catalyst conditioning addition is shown in FIG. 2. The base, or zero (0) level of treating zone 39 is taken as at level A, indicated in FIG. 1. This base level was the maximum achievable by the conventional stripper prior to lengthening to provide for catalyst conditioning. The shaded area in FIG. 2 shows the range of operation of the regenerator with the conventional stripper. Catalyst circulation rates were in the range of 21 to 23 tons per minute. Stripping steam could not be reduced below 13,000 pounds per hour without losing all excess oxygen in the regenerator flue gas. The desired operating range was defined as 16 to 17,000 pounds per hour in order to get maximum stripping without expending too much stripping steam.

Figure 3:
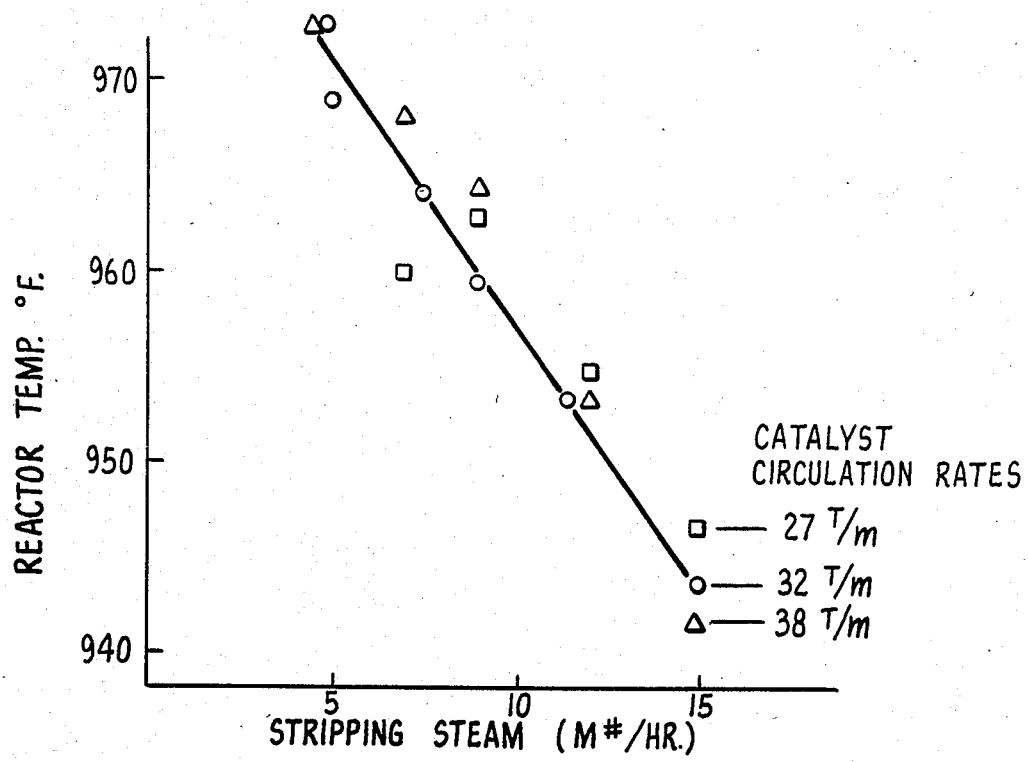
FIG. 3 is a graph of steam rate versus temperature in a riser reactor at three different catalyst flow rates for an FCC unit operating in accordance with the present invention. The torch oil rate was varied to keep the reactor temperatures comparable for the three catalyst circulation rates shown.
Figure 14:
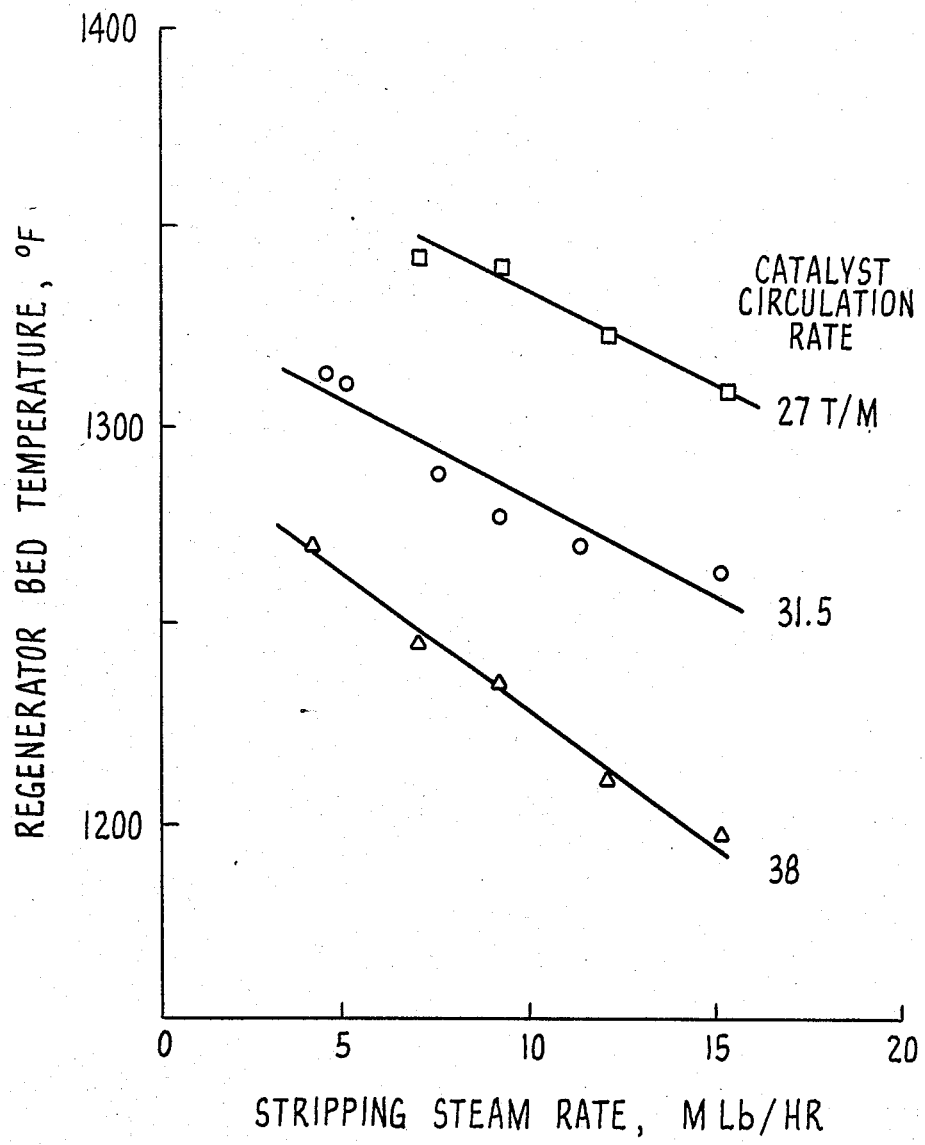
FIG. 14 shows the regenerator temperature response to various steam rates for the same steam survey as shown in FIGS. 3 and 4.

Tests after the catalyst conditioning was added to the stripper treater are shown in FIGS. 3, 4, 5, 6 and 14. All tests were made at 15 feet above base at level C in FIG. 1. The tests in FIGS. 3 and 4 were made at three different catalyst circulation rates, namely, 27, 32 and 38 tons per minute. Torch oil to the regenerator was adjusted so that the reactor temperature for each of the three catalyst circulation rates was approximately the same at the same treater steam rates. Once set, the torch oil rate was held constant and only the steam rate was varied. This type of survey produced variations in excess oxygen, reactor and regenerator temperatures. The reactor and regenerator temperature responses are shown in FIGS. 3 and 14. The reactor and regenerator temperatures displayed a surprisingly high sensitivity to stripping steam rates with the new treater section in place. Thus, neither the reactor nor the regenerator temperatures tend to flatten out at a plateau as would be expected see Venuto and Habib, ibid p 15) but surprisingly continue to decrease with increasing stripping steam rates.

Figure 4:
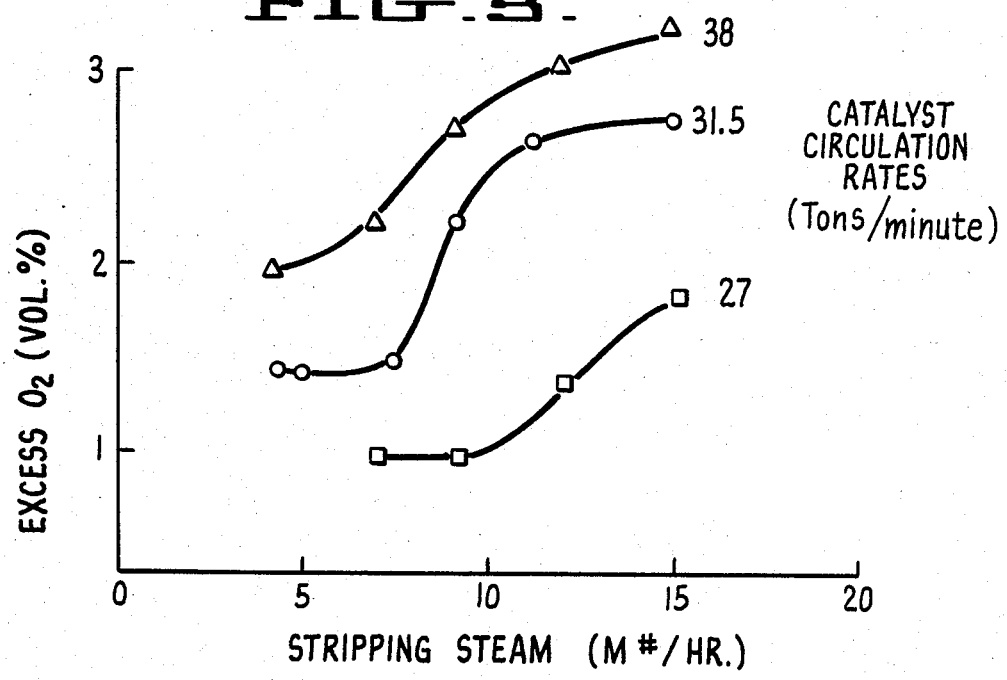
FIG. 4 is a plot of excess oxygen versus steam rate, for the same tests as those shown in FIG. 2, and illustrates the same three flow rates as in FIG. 3 for catalyst in the improved spent catalyst treating arrangement of the present invention. This figure illustrates that the minimal steam requirement with the added conditioning zone is greatly less than that for the standard stripper. In fact it is surprising that a total loss of excess oxygen was not achieved.

FIG. 4 shows the surprising result that excess oxygen was not lost for any steam rate. The higher catalyst circulation rates had more excess oxygen than the lower catalyst circulation rate cases because the coke had less hydrogen than did the torch oil that needed to be backed out in order to maintain constant reactor temperatures. FIG. 4 also demonstrates that a bare minimum of steam is necessary to reduce coke delivered to the regenerator for a conventional stripper followed by an additional spent catalyst treating zone.

Figure 5:
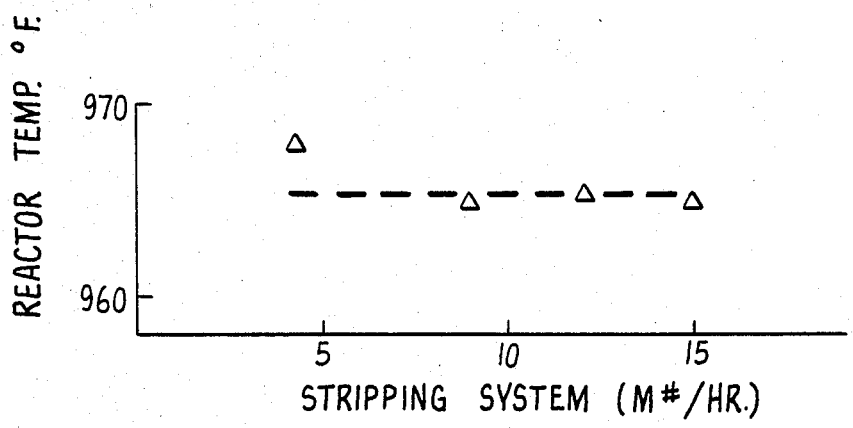
FIG. 5 is a plot of reactor temperature versus different steam rates in a spent catalyst conditioner operated in accordance with the improved arrangement of the present invention. The temperatures were held approximately constant by varying torch oil rate in the regenerator.
Figure 6:
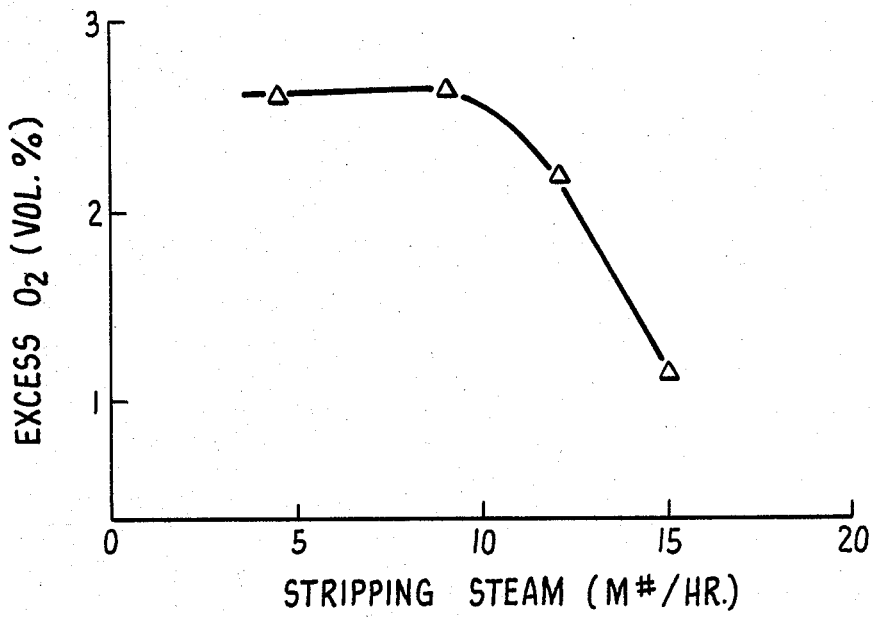
FIG. 6 is a plot, similar to FIGS. 2 and 4, illustrating reduced consumption of oxygen with increasing steam rates when additional hydrogen-rich torch oil is used in the regenerator to replace hydrogen-deficient "coke" laden catalyst returned from the improved spent catalyst treater arrangement of this invention. The data shown in FIG. 6 are for the same tests shown in FIG. 5.

A second type of steam survey was conducted and its results are shown in FIGS. 5 and 6. In this survey, the reactor temperature was held constant (approximately 965° F.) by varying torch oil to the regenerator as the steam rate was varied. At high steam rates, lots of torch oil had to be fed to the regenerator to keep the reactor temperature at 965° F. Consequently, the excess $O_2$ dropped, again indicating that the coke that was prevented from fueling the regenerator by the increased steam is, indeed, less rich in hydrogen than the torch oil.

Additionally, tests were made to find the effect on FCC product yields by the spent catalyst conditioning space added below the conventional stripper section, all comprising the spent catalyst treater. The test conditions are listed in Table 1 below and the observed yield shifts are given in Table 2.

TABLE 1

| Test Conditions for Yield Shifts vs. Stripper Height | |
|---|---|
| Reactor Temperature | 965° F. |
| Catalyst Circulation Rate | 27 tons/minute |
| Feed Rate | 54,800 barrels/day |
| Regenerator Temperature | 1340° F. |
| Feed | Arabian Gas Oil |
| Stripper Height | Base, +6, +15 feet |

TABLE 2

| Yield Shifts for Stripper Height Tests | | | | | | |
|---|---|---|---|---|---|---|
| | TEST 1 | | TEST 2 | | TEST 3 | |
| | wt % | vol % | wt % | vol % | wt % | vol % |
| Coke | 3.56 | | 3.08 | | 3.16 | |
| $C_4$-Gas | 14.98 | | 13.30 | | 14.29 | |
| $C_2$- | 3.79 | | 3.25 | | 3.84 | |
| Sum $C_3$ | 4.87 | 8.56 | 4.16 | 7.27 | 4.54 | 7.97 |
| Sum $C_4$ | 6.32 | 9.72 | 5.89 | 8.95 | 5.91 | 9.00 |
| Gasolines | 43.22 | 51.07 | 41.89 | 49.75 | 39.66 | 47.05 |
| $C_5$-265° F. | 22.52 | 28.63 | 22.25 | 28.19 | 20.76 | 26.22 |
| 265°-430° F. | 20.70 | 22.44 | 19.64 | 21.56 | 18.90 | 20.83 |
| Cycle Oils | 38.21 | 36.85 | 41.59 | 40.42 | 42.75 | 41.69 |
| 430°-540° F. | 11.35 | 11.36 | 11.28 | 11.35 | 11.09 | 11.19 |
| 540°-650° F. | 9.16 | 8.89 | 9.67 | 9.43 | 9.88 | 9.67 |
| 650° F.+ | 17.70 | 16.60 | 20.64 | 19.64 | 21.78 | 20.84 |
| $H_2S$ | 0.03 | | 0.14 | | 0.14 | |
| Totals | 100. | 106.20 | 100. | 106.39 | 100. | 105.71 |
| Conversion | 61.79 | 63.15 | 58.41 | 59.58 | 57.25 | 58.31 |
| Treater height (feet above base) | 15.(Level C) | | 6.(Level B) | | 0.(Level A) | |

Tests were made on consecutive days keeping the feed and catalyst the same throughout the test program. The level of catalyst in the treater is fixed by the height of treater zone 39, as shown in FIG. 1. The level of the catalyst in the treater was varied by dropping catalyst out of the system (rather than by adding catalyst) to keep the catalyst composition and reactivity constant throughout the 3 day test period. Regenerator temperatures were kept constant, which thereby kept the reactor temperature constant, by varying torch oil rate, as the stripper level was lowered.

The method of sampling the FCC product streams and constructing weight balanced yield summaries was as described in the literature. (e.g., R. L. Flanders, et al, *Oil & Gas Journal,* pp 84–86, 1/9/61). This method is more precise than by monitoring control room strip charts. However, control room strip charts confirmed these shifts also. The added catalyst conditioning (i.e. by increasing the height of the dense phase) surprisingly gives a decrease in heavy cycle oils with a corresponding increase primarily of gasolines. These results are graphically shown in FIGS. 12A to 12D, as noted.

While the changes shown in the tables and graphically in FIGS. 12A–12D represent only a few percent change in upgraded products, the financial advantage of the present invention are indeed significant. At the rate of 54,800 barrels per day an improvement of 1% in gasoline at 25 cents/gal (assuming 25% of $1/gallon value increase of gasoline over heavy cycle oil) represents a net gain of over $7,500/day. The noted results of 3 to 4% improvement would have a value of $22,500 to $30,000/day (approximately $10 million/year).

Coke Reduction

Figure 13:
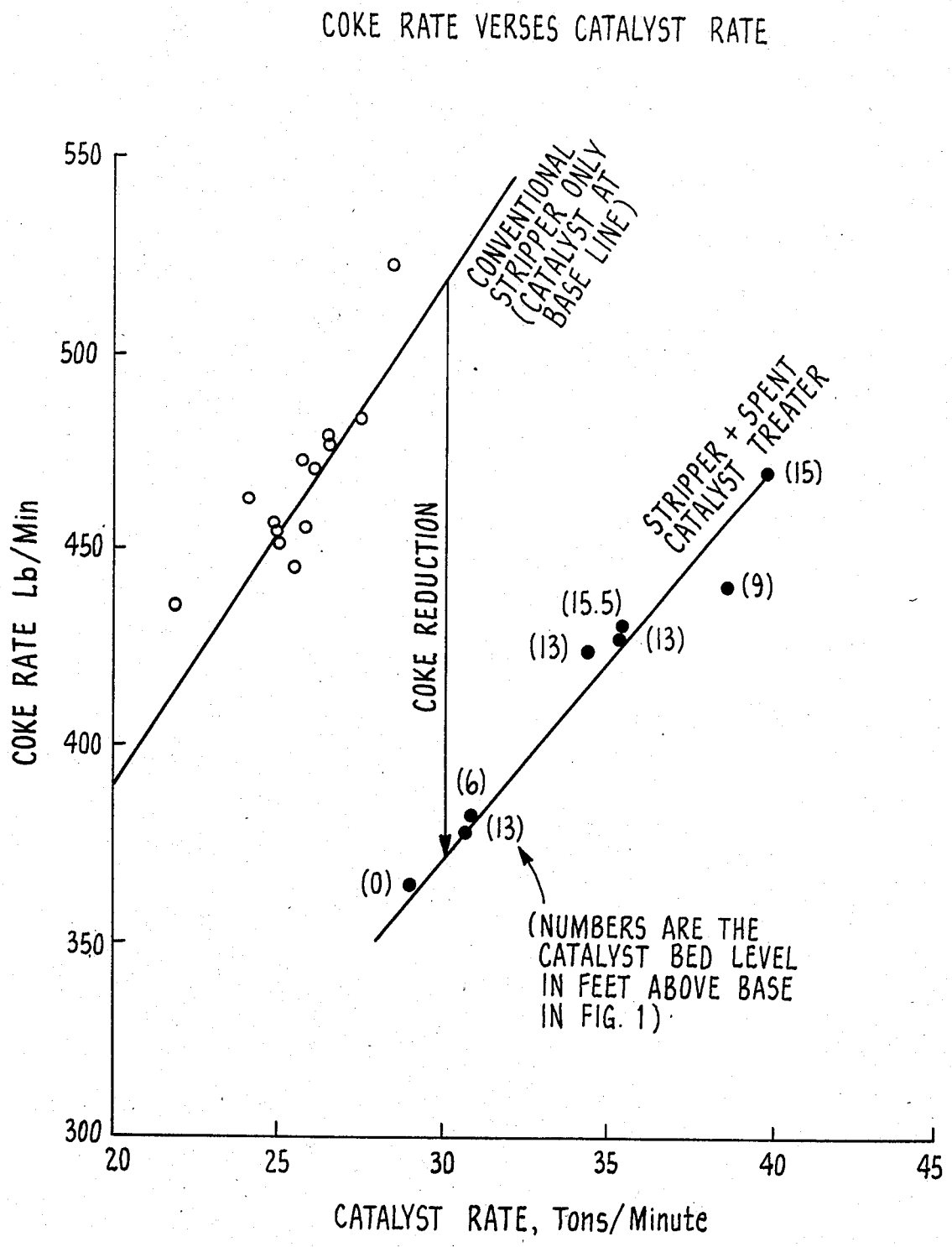
FIG. 13 shows the coke rate reduction by one commercial FCC unit due to addition of the spent catalyst treating zone.

Additional tests were made on this plant in general accordance with FIG. 1. These tests show that addition of the spent catalyst treating zone resulted in a desirable reduction in coke yield irrespective of the catalyst bed height in this zone. Data from these tests are plotted in FIG. 13. Notice that the coke yield was reduced for all bed heights, but as previously shown in Table 2, the yields are improved with high bed heights. Thus I conclude that although spent catalyst conditioning for gasoline yield increase is dependent on how much catalyst is in the treating zone, spent catalyst stripping for coke removal is just as effective by dilute phase stripping of the catalyst as it falls to the bed as by dense phase stripping of the catalyst in the bed.

Further Embodiments of Invention

The arrangement of FIG. 7 is similar to that of FIG. 1 except that riser reactor pipe 25 is primarily external to reactor separator vessel 21. Riser pipe 25 enters reactor-separator 21 on a downward course from outlet 27 onto catalyst disengaging baffle 51. In the present arrangement, it is desirable to have adequate insulation 29 around spent catalyst treating column 11 forming a substantial part of zone 39 so that the catalyst temperature is maintained substantially the same as at the riser outlet during the extended residence time period contemplated by the present invention. Additional residence time in the treater section 39 performs the unexpected function of conditioning or modifying the catalyst so that upon regeneration and recycle to the reaction zone more desirable product in the gasoline boiling range is obtained at the expense of less desirable heavy cycle oil. In FIG. 7 overhead gas or vapor recovered in overhead space 42 through cyclones 41 passes through a plenum chamber 46 for flow through line 45 to a conventional fractionation or distillation system, such as that shown in FIG. 9.

Figure 8:
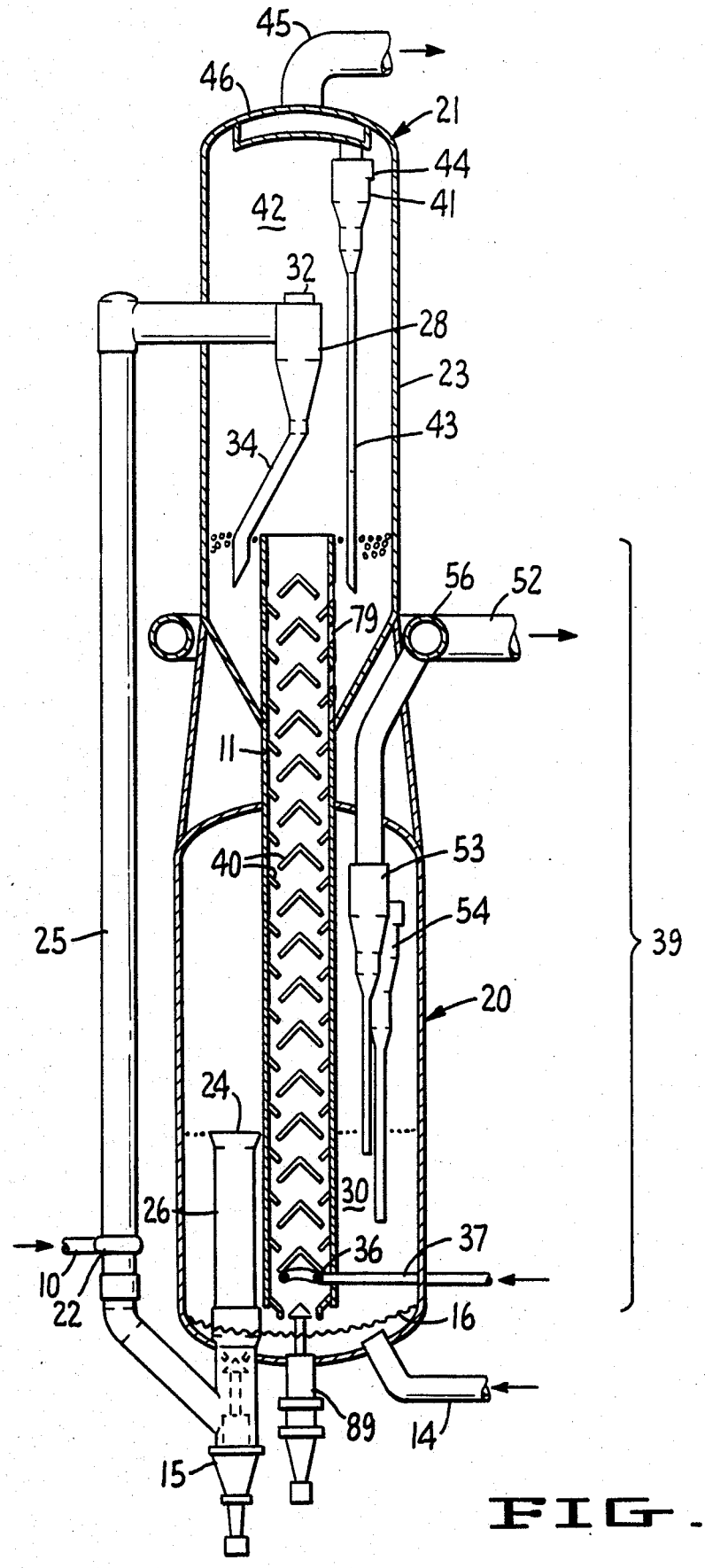
FIG. 8 is an alternate arrangement, in schematic form, similar to FIGS. 1 and 7, of a stacked reactor-separator-regenerator FCC unit in which the spent catalyst treating zone extends continuously from the separator inlet into the regenerator decoking zone.

FIG. 8 illustrates a further embodiment of the arrangement of FIGS. 1 and 7 in which spent catalyst treater column 11 of zone 39 has been extended down through the regenerator vessel 20 so that vessel 21 and regenerator 20 are built as essentially one vertical unit. In this way, the temperature of treating zone 39 is raised by contacting with the hot regenerator vessel and bed. The hot regenerator catalyst bed can heat the spent catalyst to further accelerate catalyst conditioning and coke removal. In this embodiment, the hydrocarbon-catalyst reaction mixture enters reactor-separator vessel 21 from riser reactor 25 through a side opening in vessel wall 23. The mixture is separated in cyclone means 28 arranged to discharge spent catalyst through dip leg 34. Hydrocarbon vapors enter vapor space 42 from port 32 in catalyst disengaging cyclone 28.

As particularly distinguished from the arrangements of FIGS. 1 and 7, treating zone 39 is in the form of a continuous flow tube 11 which extends into regenerator 20. Baffles 40 assure proper contact of spent catalyst in treater 39 with steam emitted from below. Valve 89 regulates catalyst flow so that the spent catalyst passing through the treater zone is adequately stripped and then conditioned and in addition brings about some cracking of hydrocarbons resident on the catalyst. Such particles are held at the elevated temperatures by disposing a substantial portion of tube 11 in heat exchange with hot combustion gases evolved and especially the hot catalyst bed 30 in regenerator 20. Accordingly tube 11 provides the dual function of a longer tube for flow of catalyst to the regenerator and raising the temperature of the spent catalyst after some extended conditioning time to rapidly complete the conditioning and stripping processes.

Control of the rate of flow through column 11 is by plug valve 89. Valve 15 controls the rate of catalyst return to the reactor section. Air or other oxygen-containing gas is introduced through line 14. A two-stage regenerator cyclone, such as 53 and 54, is used to recover stack gases evolved during regeneration of the catalyst. An external plenum 56 is connected to the vapor outputs of cyclones 53 and 54. In turn, plenum 56 is connected to flue gas line 52 (like line 19 in FIGS. 1 and 7).

Figure 9:
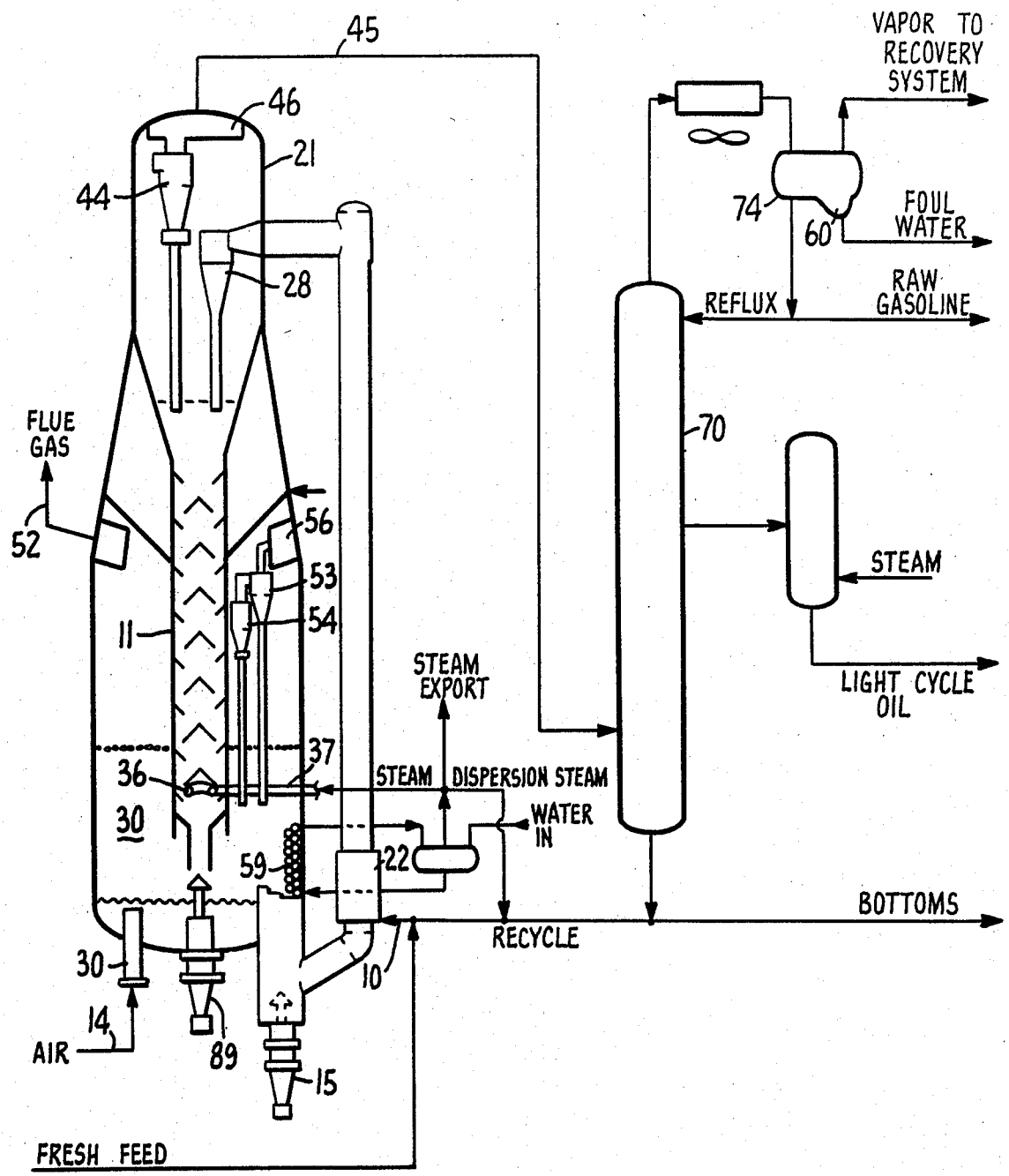
FIG. 9 is a schematic representation of a further alternate to the FCC arrangement of FIG. 8, particularly illustrating the present invention applied to another conventional form of FCC unit.

FIG. 9 illustrates another embodiment of the invention similar to the arrangement of FIG. 8. Spent catalyst is held in treater column 11 at reaction conditions to strip out volatiles and to condition this catalyst in the presence of steam and additionally to generate additional cracked hydrocarbon gases from the residual hydrocarbons on the catalyst. When the period of time is long enough, and temperature is adequate, such additional products can be generated with less steam since the gases produced aid in the stripping action. As noted above, under certain circumstances substantially reduced quantities of steam may be required. Steam is supplied by manifold 37 to nozzle 36 in column 11. FIG. 9 additionally shows schematically flow of reaction products from reactor separator 21 through line 45 to a fractionator column 70. As indicated several streams of hydrocarbons having different boiling ranges may be recovered from column 70. These are designated as raw gasoline, light cycle oil, vapors and bottoms. A steam generator 72 for producing stripping steam (and/or "export steam") is also shown. As indicated, excess heat produced in the regenerator can be removed by a heat exchanger whose tubes 59 are in the regenerator catalyst bed.

In operation of the present invention, a substantial reduction in the production of "foul water" with the recovered, cracked hydrocarbons is obtained by introducing less steam into the spent catalyst treater. Such foul water is recovered as indicated by drop out pot 60 forming part of separator 74 connected to the overhead system for fractionator 70. The volume of such foul water also affects the overall economic efficiency of an FCC unit since excessive production of foul water is a cost to the operation.

Figure 10:
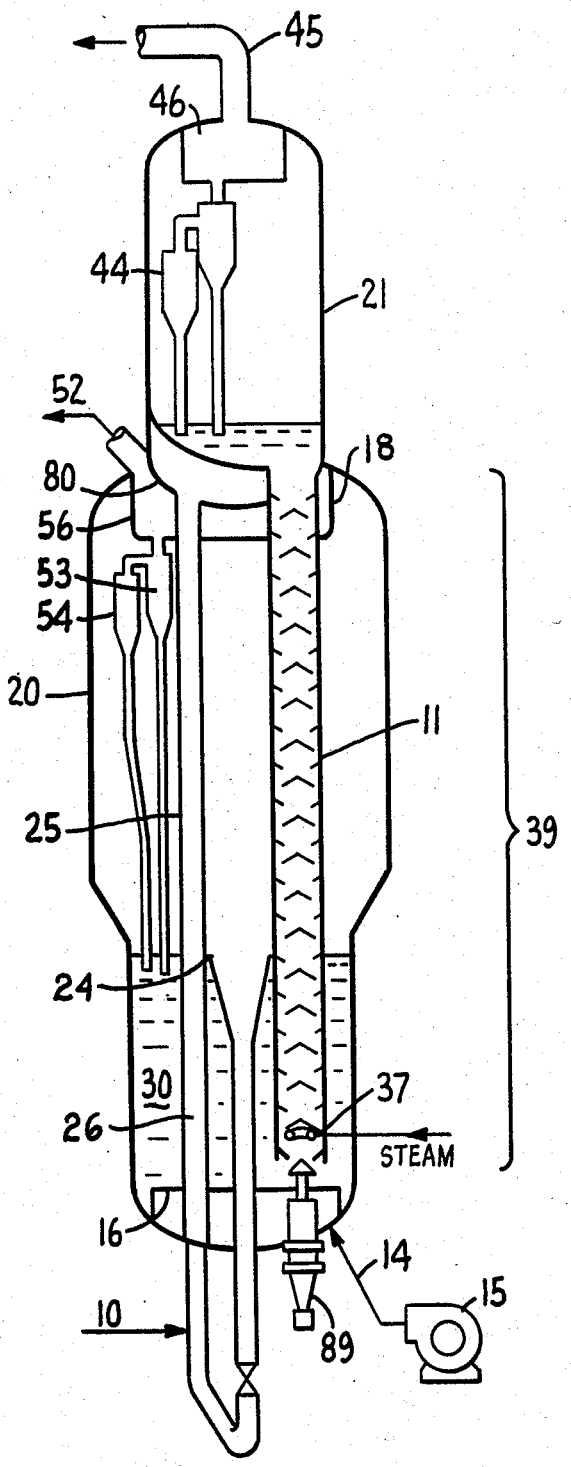
FIG. 10 is another schematic representation of a conventional form of an FCC unit, similar to FIGS. 8 and 9, having included therein embodiments of the present invention.
Figure 11:
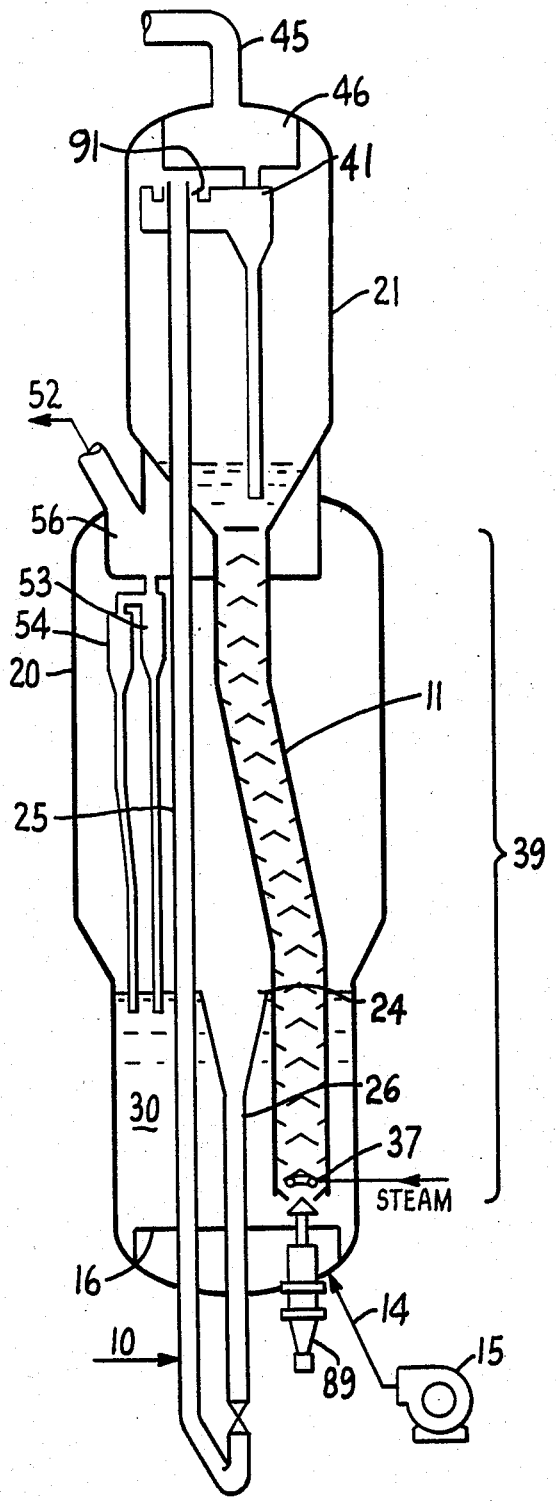
FIG. 11 is still a further schematic representation of an FCC unit embodying the present invention.
Figure 12B:
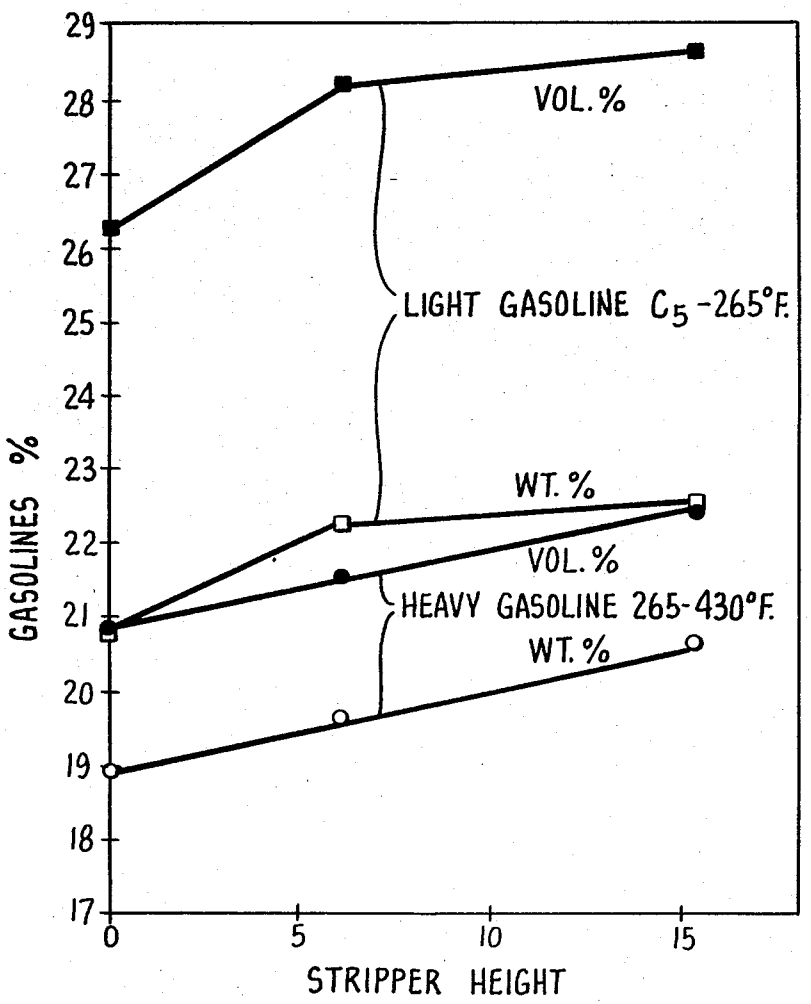
FIGS. 12A, 12B, 12C and 12D are graphic representation of improved product yields, particularly illustrating the test results shown in Table I.
Figure 12A:
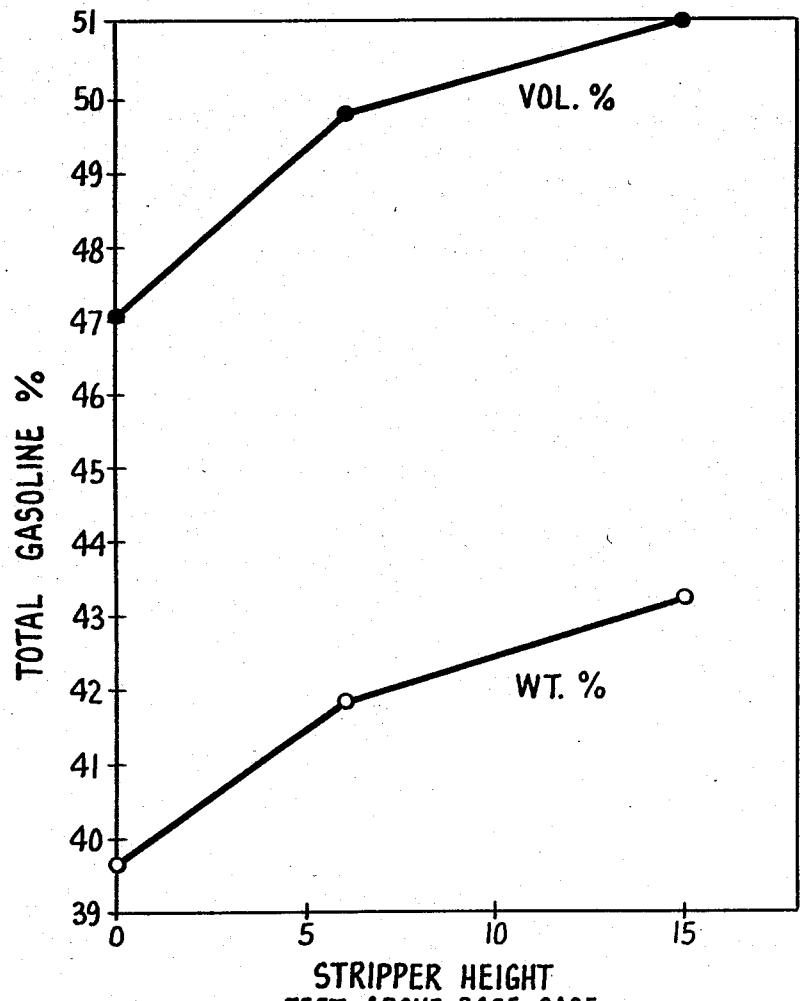
Figure 12D:
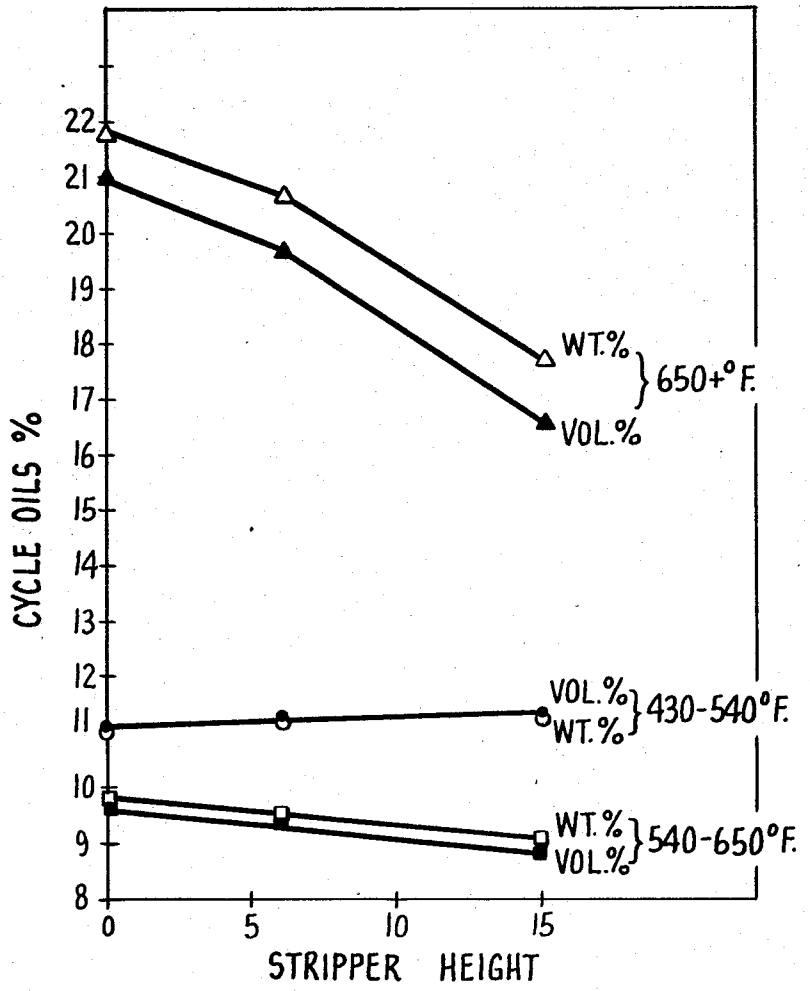
Figure 12C:
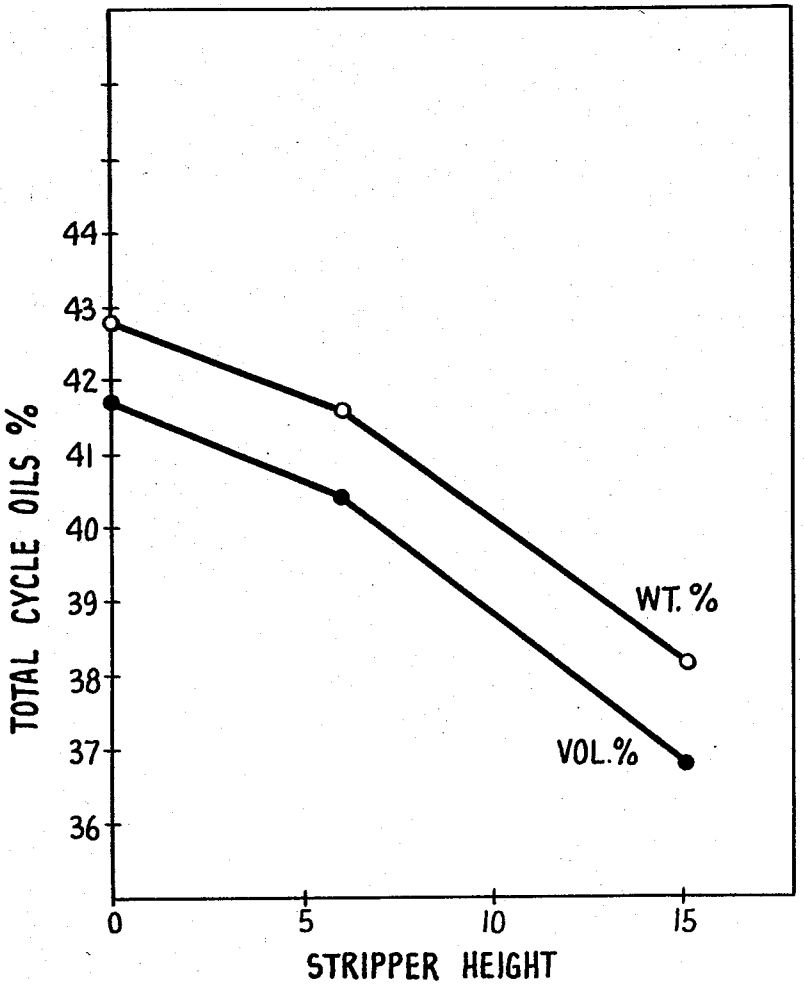

FIGS. 10 and 11 show still further embodiments of fluidized catalytic cracking units embodying the present invention.

FIG. 10 shows such a unit operating in a riser reactor mode wherein fluidized hydrocarbon feed and catalyst are reacted over a generally longer time period. In such a system spent catalyst treating column 11 can also be extended into the regenerator vessel to provide elevated temperatures for additional reaction of the adsorbed hydrocarbons on the spent catalyst.

The unit shown in FIG. 11 particularly favors short reaction times. This can be obtained by an annular cup means 91 open in the upper surface thereof adjacent the discharge opening of the riser 25, whereby vapors are collected for passage to cyclone 41 (only one cyclone is shown, although two or more can be used). Such an arrangement for separating vapors from the reaction mixture of hydrocarbonaceous material and catalyst is illustrated in the upper portion of FIG. 1 of U.S. Pat. No. 4,435,279 which as to this aspect is incorporated by reference. As indicated, spent catalyst in treater 11 may either flow downwardly in a straight line from the center of separator vessel 21 to regenerator 20, as in FIG. 10, or through an offset from center as in FIG. 11.

Operation of a system, described in connection with each of the embodiments of FIGS. 1 and 7 through 11 above, reduces substantially the load on regenerator 20 in terms of oxygen (air) needed to run the process and to greatly reduce the load on spent catalyst treater 11 in terms of the amount of steam needed to run that part of the process. These improvements primarily provide (1) improved yield structures at the same conditions (plus savings in stripping steam and resultant foul water), (2) the ability of the process to run "heavier" (ie. greater coke making tendency) feeds, and/or (3) greater throughputs of the same feed.

While stripping efficiency for lowered coke formation appears to increase with increased total size of the stripping/treating zone, the added conditioning zone obtained by the elongated treating zone provides the improved catalyst characteristics which after regeneration give greater yields of the desirable products such as gasoline and lowered yields of the less desirable products such as cycle oils (i.e., improved selectivity). Thus, coke reduction is obtainable and in addition greater selectivity is obtained.

As discussed above, these beneficial effects are achieved by elongating the stripper to such a length that coke conditioning as well as dealkylation of residual hydrocarbons apparently occurs. This length is substantially in excess of that which gives conventional stripper performance for fluidized catalytic cracking units, as particularly illustrated by the differences in steam surveys in FIGS. 2 and 4. By lengthening stripping zone 39, it is believed, and results so indicate, that not only is the "coke" level reduced but with the zeolitic catalysts the spent catalyst is so conditioned or modified that after regeneration the catalyst promotes superior cracking yields of gasoline and lowered production of heavy cycle oil. The volatile gases from this treating zone serve to help desorb volatile hydrocarbons in the conventional stripping zone. The remaining hydrocarbons are much more hydrogen deficient and thus require much less oxygen to regenerate the catalyst. The prevailing chemistry in this treating zone is believed to be dealkylation of aromatics:

$$\underset{\substack{\text{(adsorbed)}\\ \text{nonvolatile}\\ \text{hydrocarbon}}}{R{-}CH_2CH_2CH_3} \xrightarrow[\text{catalyst + time}]{} \underset{\substack{\text{(adsorbed)}\\ \text{nonvolatile}\\ \text{hydrocarbon}\\ \text{(hydrogen}\\ \text{deficient)}}}{R{-}H} + \underset{\substack{\text{(gas)}\\ \text{volatile}\\ \text{hydrocarbon}\\ \text{(hydrogen}\\ \text{rich)}}}{H_2C{=}CHCH_3}$$

These volatile gases may be sufficient to perform a stripping action which allow for the very low permissible stripping steam rates shown in FIG. 4 for this novel spent catalyst conditioning unit. Starting with a C:H of 1:1, the percent $O_2$ increase in the regenerator by removing all of the hydrogen as olefin, methane or hydrogen, is given below:

| volatile product | % $O_2$ requirement reduction |
|---|---|
| olefin | 60% |
| methane | 40% |
| hydrogen | 20% |

Of course, if additional desorption occurs, 100% $O_2$ is saved for that which is desorbed. Such calculations show a diminishing return after all of the alkyl groups have been removed.

Some measurements indicate that the increased yields of hydrocarbon conversion products occurs not only in the elevated stripper, but in the reactor as well due to effects caused by the elevated stripper. The conditioning of the "coke" in the elevated stripper apparently leaves the catalyst more reactive upon regeneration at the same levels of carbon on regenerated catalyst. The data supporting this hypothesis are shown below for the same three tests mentioned earlier in Tables 1 and 2.

| | Test 1 | Test 2 | Test 3 |
|---|---|---|---|
| Stripper height (feet above base) | 15 (level C) | 6 (level B) | 0 (level A) |
| Carbon on regenerated catalyst (wt %) | 0.014 | 0.013 | 0.013 |
| Heat of cracking reaction, BTU/lb. of feed | 260 | 330 | 355 |
| PACT conversion, $C_{19-}$ | 51.9 | 48.1 | 45.0 |
| Observed conversion, wt % to 650°– | 82.3 | 79.4 | 78.2 |

These data show that the observed heat of cracking calculated from the heat balance drops with stripper height increases indicating a shift in product structure. This is consistent with the results shown in Table 2. The additional conversion increase made primarily liquids, not gases. The conversions of hydrocarbons heavier than 19 carbon atoms to those lighter than 19 carbon atoms ($C_{19-}$) by pulsed activity catalyst testing (PACT) on a lighter feed but using the catalyst from this test program is definitely greater for regenerated catalyst after conditioning of the coke in an elevated stripper than for regenerated catalyst after conditioning in the conventional stripper which corresponds to the observed conversion shifts. The pulsed micro activity test measures the catalyst activity in the first increment of riser length. Therefore, the observed yield increase shown in Table 2 comes from the more active catalyst in the reactor. This catalyst activity was increased by the additional treatment of coke and catalyst in the elevated stripper. Furthermore, the change in heat of reaction is consistent with the data in Table 2 which shows that the stripper with added catalyst conditioning gives incremental conversion to light liquids, not gases, and thereby has a lower heat of cracking.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressely intended that all such variations and changes which fall within the spirit and scope of the present invention as defined in the following claims be embraced thereby.

I claim:

1. In a fluid catalytic cracking process wherein the hydrocarbon feed contacts a crystalline zeolitic cracking catalyst for not longer than 10 seconds in a reaction zone and thereafter said catalyst is separated from the relatively dispersed phase of said reacting mixture of heated catalyst and hydrocarbon vapors, the resultant dense phase of spent catalyst is stripped of entrained or adsorbed hydrocarbon vapors by passing flowing steam through said dense phase before return of the resulting stripped catalyst which is essentially free of volatile hydrocarbons but containing residual nonvolatile hydrocarbons as coke, to a regenerator for oxidative regeneration including oxidation of said coke and recirculation of the resultant heated and regenerated catalyst for contact with additional hydrocarbon feed, the improvement comprising subjecting said dense phase of spent crystalline zeolitic catalyst after said normal steam stripping of hydrocarbon vapors to an additional period of time at substantially the same temperature as in said normal steam stripping step and below about 1000° F. and in the presence of steam, said steam added in an amount and to an extent during said additional period of time so that steam reacts with coke on the catalyst to form hydrocarbon gas, said additional period of time being sufficient to modify catalyst and/or coke thereon, whereby upon subsequent oxidative regeneration and recycle of said zeolitic catalyst to the reaction zone there results an increase in conversion when compared to an absence of said additional period of time.

2. The process of claim 1 wherein said additional period of time ranges from ½ to 30 minutes.

3. The process of claim 1 wherein said additional period of time is 1.2–5 times that of the normal stripping period.

4. A proces of claim wherein said additional period of time is from 1 to 10 minutes.

5. A method of improving the overall efficiency of a fluid catalytic cracking system to convert higher boiling range hydrocarbons to lower boiling range hydrocarbons, which comprises reacting a fluid mixture of crystalline zeolitic catalyst particles and said higher boiling range hydrocarbons as a relatively dispersed phase in a reaction zone for a period of time not longer than 10 seconds, separating said catalyst from product hydrocarbon vapors to form a relatively dense phase into a spent catalyst treating zone, then first flowing stream through the dense phase of spent crystalline zeolitic catalyst particles to strip therefrom entrained or adsorbed hydrocarbon vapors, thereafter reacting the resultant stripped catalyst at a temperature below about 1000° F. with further steam in an amount and for a time to modify catalyst and/or coke on the catalyst to form hydrocarbon gas whereby upon subsequent oxidative regeneration and recycle of said catalyst to said reaction zone there results an increase in conversion compared to the absence of said further amount of steam and time, said further steam reaction continuing for a period of time at least six times longer than the residence time of said mixture in said reaction zone and at a temperature not less than about said reaction temperature, thereafter regenerating said spent catalyst by contacting it with an oxygen containing gas, and then returning said regenerated catalyst to said reaction zone with additional feed hydrocarbons, whereby said process efficiency is improved.

6. A method of improving the overall efficiency of a fluid catalytic cracking system to convert higher boiling range hydrocarbons to lower boiling range hydrocarbons, which comprises reacting a fluid mixture of crystalline zeolitic catalyst particles and said higher boiling range hydrocarbons as a relatively dispersed phase in a reaction zone for a period of time not longer than 10 seconds, separating spent crystalline zeolitic catalyst from product hydrocarbon vapors to form a relatively dense phase in a spent catalyst treating zone, flowing steam through said spent catalyst in said treating zone to separate hydrocarbon vapor from said spent catalyst, then further reacting said spent catalyst with steam in said treating zone for an additional period of time from 6 to 900 times longer than said reaction time period and maintaining said spent catalyst at an elevated temperature not substantially less than the reaction temperature of said fluid mixture to modify catalyst and/or coke on the catalyst to form hydrocarbon gas thereon by reaction with steam at a temperature less than about 1000° F., said elevated temperature being maintained without addition of greater amounts of steam thereto, then regenerating said catalyst by flowing an oxygen-containing gas through the resultant treated catalyst and returning said regenerated catalyst to said reaction zone with additional hydrocarbon fluids, whereby said efficiency of said cracking method is improved compared to the absence said additional period of time as to at least one of the following process conditions:

(a) improved yields of light liquid and gaseous hydrocarbon products without change in process flow rates with corresponding decrease of heavy liquid products and coke, (b) heavier hydrocarbons are used as feed material to said system without decrease in product yield, (c) hydrocarbons are fed at a greater rate to said system at the same conversion level, (d) hydrocarbons are fed to the reaction zone with reduced recycling of product therewith, (e) the quantity of additional catalyst being added during said regeneration step is reduced, (f) normal steam stripping of the spent catalyst is reduced, (g) the amount of oxygen required for regeneration is reduced, and (h) the amount of foul water in the recovered hydrocarbon products is reduced.

7. The method of claim 6 wherein the treating zone temperature of said spent catalyst is maintained by counterflow heat exchange of said spent catalyst with the heated reaction mixture in said reaction zone.

8. The method of claim 6 wherein the treating temperature of said spent catalyst is maintained by insulation around said stripper zone.

9. The method of claim 8 wherein said treating zone temperature is maintained by counterflow of said spent catalyst with the regenerator off gas.

10. The method of claim 6 wherein said treating zone temperature is maintained or increased by positioning said zone at least partially within the hot regeneration zone.

* * * * *